United States Patent [19]

Kwan

[11] 4,098,389

[45] Jul. 4, 1978

[54] THREE POSITION PLATEN CONTROL MECHANISM

[75] Inventor: Okun Kwan, Trumbull, Conn.

[73] Assignee: Bunker Ramo Corporation, Oak Brook, Ill.

[21] Appl. No.: 716,310

[22] Filed: Aug. 20, 1976

[51] Int. Cl.[2] ..... B41J 11/20; B41J 11/10

[52] U.S. Cl. ..... 400/649; 269/63; 400/124; 400/58

[58] Field of Search ..... 197/144, 149, 1 R, 127 R, 197/133 R, 148, 115, 55; 269/55, 63, 289, 321 H

[56] References Cited

U.S. PATENT DOCUMENTS

| | | | |
|---|---|---|---|
| 3,718,295 | 2/1973 | Priebell et al. | 197/127 R |
| 3,802,546 | 4/1974 | Helms | 197/133 R |
| 3,817,365 | 6/1974 | Zimmerman | 197/1 R |
| 3,837,457 | 9/1974 | Anglin et al. | 197/55 |
| 3,848,720 | 11/1974 | Carlsen | 197/144 |
| 3,912,068 | 10/1975 | Kwan et al. | 197/149 |
| 3,952,853 | 4/1976 | Feldman | 197/55 |
| 3,995,730 | 12/1976 | Kwan et al. | 197/127 R |

*Primary Examiner*—William Pieprz

*Attorney, Agent, or Firm*—F. M. Arbuckle; Israel Gopstein

[57] ABSTRACT

A platen control mechanism includes a cam member which urges a cam following platen into three positions during a printing cycle. Two separate solenoids are connected to the cam member for moving the member to three distinct positions. In a first position both solenoids are de-energized thereby causing the platen to assume a wide gap position with respect to a printer head. This permits the insertion of a document. In a second condition, both solenoids are energized thereby forcing the platen into pressing relationship with a printer head. A third condition exists when one solenoid is energized and the other is de-energized thereby causing the platen to assume a narrow gap position with respect to the printer head which allows indexing motion of the document. At the end of a printing operation, both solenoids are de-energized so that the platen may return to a wide gap position permitting removal of the document. The limited movement of the platen during the mentioned document indexing minimizes the time required for a printing cycle.

6 Claims, 4 Drawing Figures

THREE POSITION PLATEN CONTROL MECHANISM

FIELD OF THE INVENTION

The present invention relates to high speed printer mechanisms and more particularly to a platen control mechanism for such printers.

BRIEF DESCRIPTION OF THE PRIOR ART

In most high speed printers used today, a form or document is inserted between a printer head and a retractable platen. For example, a dot matrix printer head is used in conjunction with a movable platen, the platen pressing a document against the printer head during a print operation. The platen retracts from the printer head during insertion, removal and indexing motion of the printer head.

Although the described platen mechanism of the prior art operates generally satisfactorily, there is lost motion during the document indexing position of the platen. This is due to the fact that the platen is moved to a fully retracted position which leaves a wider gap between the platen and the printer head than is necessary. Thus, in a repetitive process of line-by-line printing, there is a time accumulation during document indexing which is unnecessary. Accordingly, it would be advantageous to create a third position for the platen during document indexing whereby the platen would be retracted to a lesser extent than during the home position, the smaller gap permitting movement of the document between the platen and the head yet not being so great as to necessitate additional movement and time to repeatedly return the platen to the fully opened gap that exists in the home position.

BRIEF DESCRIPTION OF THE PRESENT INVENTION

The present invention is an improvement of the retractable platen mechanism utilized in high speed printers as described. Basically, the invention introduces multiple solenoids for interaction with a platen movement mechanism in a manner creating a third position for the platen, namely a document indexing position. In this document indexing position, the platen is moved to a narrow gap position relative to the printer head. The narrow gap is sufficient to permit passage of a document between the platen and the printer head during indexing but is not so great as required for the insertion and removal of the document, which occurs during the home position. By requiring less movement of the platen during document indexing, there is a time savings that becomes accumulated for each line which is printed. This becomes significant in applications of high speed printers.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
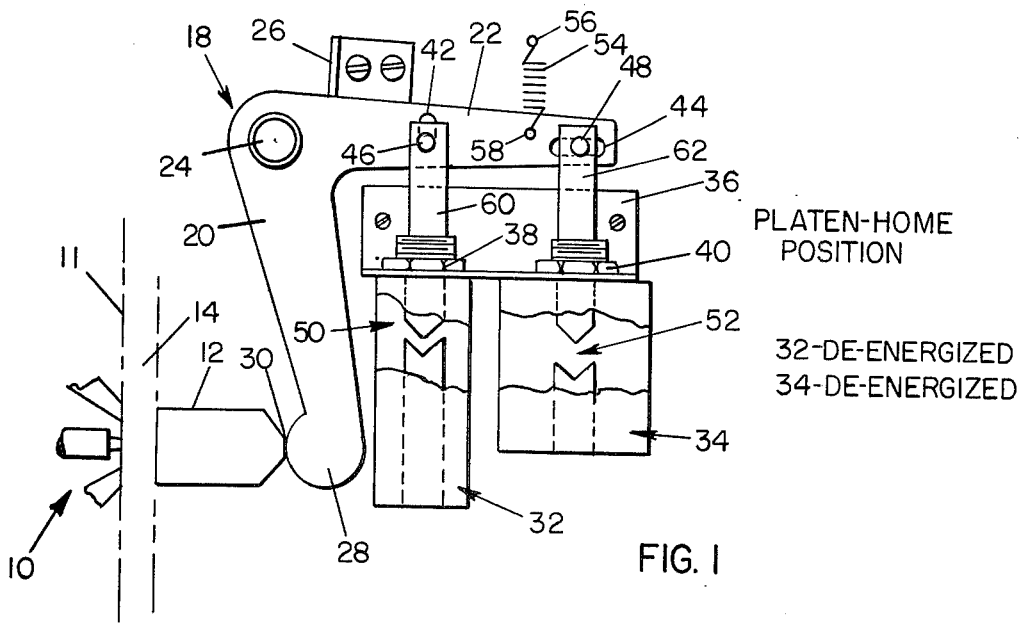
FIG. 1 is an elevational view of the platen control mechanism during the home position when documents may be easily inserted and retracted from the platen.
Figure 2:
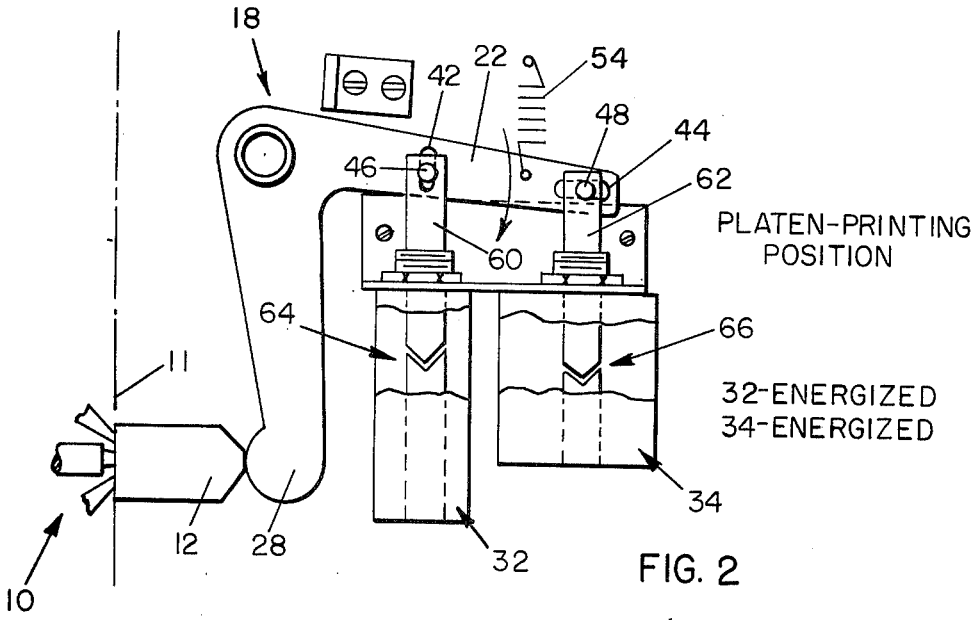
FIG. 2 is a view similar to that of FIG. 1 but indicates the disposition of the mechanism components during a printing operation.

Referring to the figures and more particularly FIG. 1 thereof, the present platen control mechanism is shown in a home position. In this position, documents may be inserted and withdrawn, easily, from the mechanism. Reference numeral 10 denotes a conventional printer head such as a dot matrix printer head. The printer head is co-planar with the printing plane 11. A conventional platen 12 is positioned in normally aligned spaced relation from the printer head 10, across a gap 14 which is variable in width, depending upon the position of the platen. Thus, in the printing position shown in FIG. 2, the gap is eliminated as the platen 12 is pressed against the printing head 10 with a document (not shown) being disposed inbetween the head 10 and the platen 12. In a document indexing position shown in FIG. 3, the gap 16 is shown to be significantly less than the gap 14 of FIG. 1 to permit the sliding movement of a document (not shown) between the head 10 and the platen 12. After a document has undergone a complete printing operation, the mechanism will return to the state shown in FIG. 1 wherein the document may be removed. The relationship between the platen 12 and the printing head 10, as shown in the home position of FIG. 1 and the printing position of FIG. 2 is completely conventional. However, it is the additional relationship of platen 12 and head 10, in an indexing position, which is unique.

Again referring to FIG. 1, the structure of the mechanism is further seen to include a bell crank 18 having a first arm 20 articulating to a second arm 22, the arms being pivotally mounted upon a pivot pin 24. The upper edge of arm 22 abuts a mechanical stop 26, which may be in the form of a stationary bracket. Engagement between the arm 22 and the mechanical stop 26 occurs in the home position of FIG. 1.

The lower end of arm 20 is rounded to form a cam surface which interfaces, at 30, with a cam follower surface of platen 12. Spring members (not shown) are conventionally used to bias the platen into engagement with cam projection 28.

Thus far, the mechanism as described is conventional. In order to move the platen 12 from the home position to the printing position shown in FIG. 2, the prior art generally utilizes a single solenoid which causes the movement of bell crank 18 from the home position shown in FIG. 1 to the printing position shown in FIG. 2. This, of course, is possible by virtue of an upward and downward stroke of a solenoid plunger during the respective home position and printing position.

The departure from the prior art resides in the inclusion of two separate solenoids 32 and 34 in coacting relationship with the bell crank 18. Both solenoids are mounted to a stationary bracket 36 by means of suitable threaded fasteners such as 38 and 40. A first vertical slot 42 is formed in the arm 22 of bell crank 18 while a second horizontal slot 44 is formed in horizontal spaced relationship from the first slot 42. A clevis pin 46 secures the upper end of plunger 60 in slot 42 while a second clevis pin 48 secures the upper end of solenoid plunger 62 in slot 44.

In the home position illustrated in FIG. 1, both solenoids 32 and 34 are de-energized as diagrammatically illustrated by the gaps 50 and 52. A spring 54 has its upper end stationarily secured at 56 while the lower end 58 is mounted to the bell crank arm 22, at a point fixed between the slots 42 and 44. With the solenoids 32 and 34 de-energized, the spring 54 will normally urge the bell crank arm 22 upwardly against the mechanical stop 26 which causes full retraction of the platen 12 from the printing head 10 as shown in FIG. 1. With the fully retracted platen, document insertion and removal at the beginning and end of a printing operation are quite simple.

FIG. 2 illustrates the states of solenoids 32 and 34 in the printing position of the mechanism. This is indicated diagrammatically by the solenoid gaps 64 and 66. In the printing position, the solenoid 32 becomes energized but the clevis pin 46 associated with the solenoid 32 remains free within slot 42 and in no way interferes with the movement of bell crank 18 by plunger 62 when solenoid 34 is energized. Energization of solenoid 34 causes the clevis pin 48 to pull downwardly upon arm 22 of bell crank 18 and by so doing, the cam projection 28 cams the platen 12 into full engagement against the printing head 10.

Figure 3:
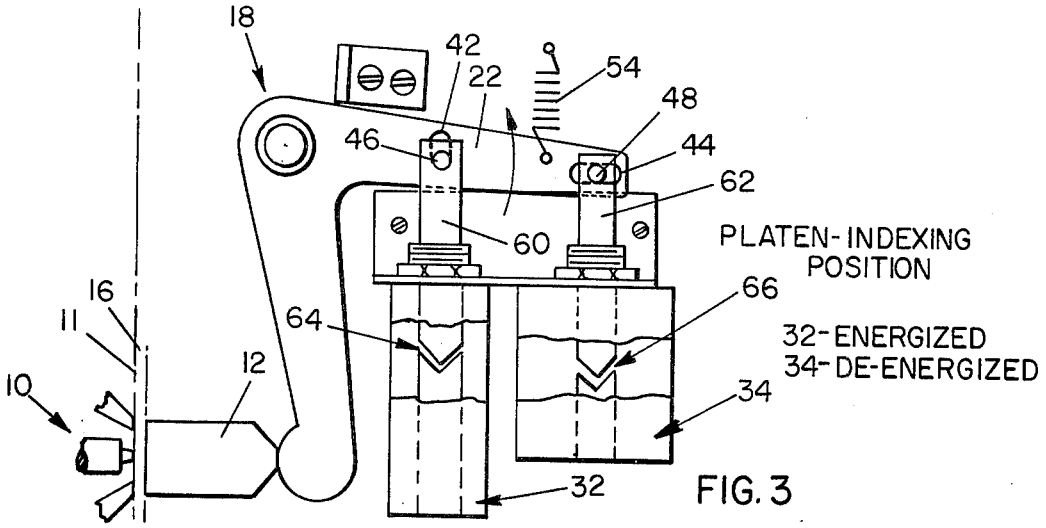
FIG. 3 is a view similar to the aforementioned views but illustrates the platen mechanism during a document indexing operation.

After a complete line of a document is printed and a new line is to be printed, the document must be indexed. To do this, a third and unique position for platen mechanisms is created as shown in FIG. 3. In the depicted indexing position of FIG. 3, solenoid 32 remains energized as indicated by solenoid gap 64 while solenoid 34 is de-energized as indicated by the solenoid gap 66. In this position, the clevis pin 46 moves downwardly in the slot 42 and holds the arm 22 of bell crank 18 against further upward movement under the bias of spring 54 thereby achieving the gap 16 shown in FIG. 3. Solenoid 34 is de-energized and since its clevis pin 48 is free to move within slot 44, it does not interfere with the guiding control of solenoid 32. At the end of an indexing operation, the mechanism will return to the home position shown in FIG. 1.

Figure 4:
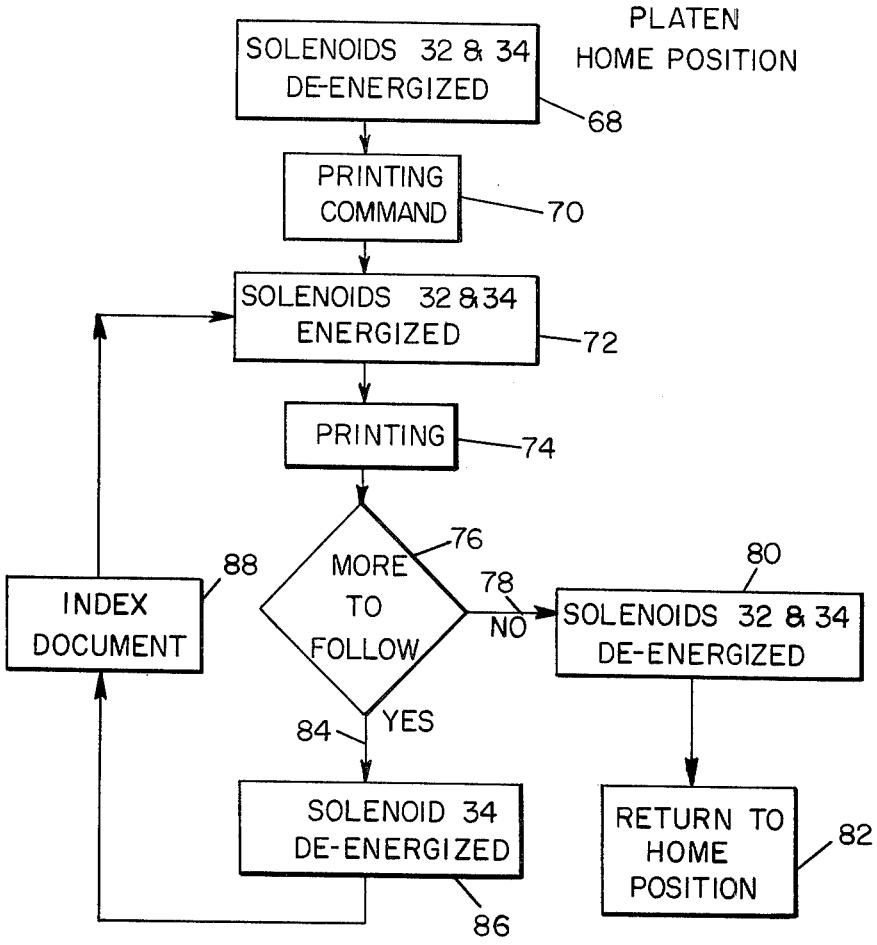
FIG. 4 is a flow chart of a complete print cycle indicating the states of the solenoids which drive the mechanism of the present invention.

FIG. 4 illustrates the various operational steps achieved by the mechanism during the home position, printing position and indexing position shown in FIGS. 1 through 3, respectively.

The platen home position is indicated at step 68 whereat solenoids 32 and 34 are de-energized. A printing command from conventional printer control circuitry (not shown) is generated at 70 and the solenoids 32 and 34 become energized at step 72. The printing of a line is completed by the printer head 10 and this step is indicated at 74. From the program controlling the printer, a determination is made as to whether subsequent lines are to follow. This decisional step is indicated at 76. If the decision is in the negative, then branch 78 is followed and the solenoids 32 and 34 become de-energized at step 80. This causes a return of the mechanism as shown at step 82 to the original home position. A subsequent printing cycle is now ready to be initiated at step 68. However, if the decisional step 76 produces an affirmative response at 84, the operation is branched to step 86 whereat solenoid 34 is de-energized and solenoid 32 remains energized. This results in the narrowed gap shown in FIG. 3. A document (not shown) which would normally be inserted in the mechanism becomes indexed such as indicated by step 88. The indexing occurs in accordance with the program controlling the printer and does not form a part of the present invention. After the indexing step at 88, the operation is returned to step 72 so that a subsequent line of printing may be initiated.

With the aforementioned description of the invention, it will be appreciated that a great improvement over prior art platen mechanisms may be realized by virtue of the introduction of a third state of platen position, namely the indexing position, which is achieved by the interaction of two driving solenoids 32 and 34 instead of a single driving solenoid as is used in the prior art.

It should be understood that the invention is not limited so the exact details of construction shown and described herein for obvious modifications will occur to persons skilled in the art.

I claim the following:

1. In a printer having a print head, a platen displaceable relative to the print head between a fully retracted position permitting insertion or removal of a document and a print position in which the document is engaged with the print head, and mechanical means for displacing the platen between said fully retracted and print positions, the improvement comprising:

plural power operated means connected to the mechanical means for effecting displacement of the platen, said plural operating means comprising two electromagnetic devices driving a common output member associated with said mechanical means, wherein:

said two electromagnetic devices are energizeable in various combinations including a combination wherein both of said devices are energized, said common output member is displaced responsive to said combinations of energization of said two devices, said mechanical means is displaced by displacement of said common output member associated therewith, and said platen is displaced by said mechanical means to the fully retracted and print positions and to a third position intermediate the fully retracted and print positions to permit indexing of the document.

2. The combination of claim 1 wherein simultaneous energization of said two electromagnetic devices displaces the platen to the print position, and further comprising means coupling the electromagnetic devices to the mechanical means for effecting displacement of the platen to the intermediate index position in response to deenergization of one of the electromagnetic devices.

3. The combination of claim 2 wherein said mechanical means includes a bell crank having a pair of lever arms, one of the lever arms being engageable with the platen, the other of the lever arms being connected to the coupling means, and thereby being connected commonly to said electromagnetic devices, and spring means connected to the bell crank for biasing the platen to the fully retracted position against the urge of the electromagnetic devices.

4. The combination of claim 3 wherein said coupling means includes a pair of transversely related pin and slot linkages.

5. The combination of claim 2 wherein said coupling means includes a pair of transversely related pin and slot linkages.

6. The combination of claim 1 wherein said mechanical means includes a bell crank having a pair of lever arms, one of the lever arms being engageable with the platen, the other of the lever arms being connected to the power operated means, and spring means connected to the bell crank for biasing the platen to the fully retracted position against the urge of the power operated means.

* * * * *